US010125793B2

(12) United States Patent
Tomita et al.

(10) Patent No.: US 10,125,793 B2
(45) Date of Patent: Nov. 13, 2018

(54) CENTRIFUGAL COMPRESSOR

(71) Applicant: MITSUBISHI HEAVY INDUSTRIES, LTD., Tokyo (JP)

(72) Inventors: Isao Tomita, Tokyo (JP); Byeongil An, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 550 days.

(21) Appl. No.: 14/762,167

(22) PCT Filed: Feb. 22, 2013

(86) PCT No.: PCT/JP2013/054613

§ 371 (c)(1),
(2) Date: Jul. 20, 2015

(87) PCT Pub. No.: WO2014/128939

PCT Pub. Date: Aug. 28, 2014

(65) Prior Publication Data

US 2015/0337863 A1 Nov. 26, 2015

(51) Int. Cl.
*F04D 29/66* (2006.01)
*F04D 17/10* (2006.01)
(Continued)

(52) U.S. Cl.
CPC ..... *F04D 29/667* (2013.01); *F04D 17/10* (2013.01); *F04D 29/053* (2013.01);
(Continued)

(58) Field of Classification Search
CPC .... F04D 29/667; F04D 29/053; F04D 29/284; F04D 29/4206; F04D 29/685;
(Continued)

(56) References Cited

U.S. PATENT DOCUMENTS 4,743,161 A 5/1988 Fisher et al.
8,272,832 B2 9/2012 Yin
(Continued)

FOREIGN PATENT DOCUMENTS

CN 1542290 A 11/2004
CN 101560987 A 10/2009
(Continued)

OTHER PUBLICATIONS

Office Action effective Aug. 3, 2016 issued in the corresponding Chinese Application No. 201380070905X with English Translation.
(Continued)

*Primary Examiner* — Mark Laurenzi
*Assistant Examiner* — Mickey France
(74) *Attorney, Agent, or Firm* — Birch, Stewart, Kolasch & Birch, LLP

(57) ABSTRACT

A centrifugal compressor which can be stably operated in a wide range by increasing an operating range on a low-flow-rate side and on a high-flow-rate side, with a simple structure of combining a recirculation flow path and a reverse swirling flow generation unit including fixed blades, without providing a complicated movable mechanism for a guide vane.

20 Claims, 15 Drawing Sheets

(51) Int. Cl.

| | |
|---|---|
| ***F04D 29/053*** | (2006.01) |
| ***F04D 29/28*** | (2006.01) |
| ***F04D 29/42*** | (2006.01) |
| ***F04D 29/68*** | (2006.01) |
| ***F04D 29/44*** | (2006.01) |
| *F04D 25/02* | (2006.01) |

(52) U.S. Cl.
CPC ..... *F04D 29/284* (2013.01); *F04D 29/4206* (2013.01); *F04D 29/4213* (2013.01); *F04D 29/444* (2013.01); *F04D 29/685* (2013.01); *F04D 25/024* (2013.01); *F05D 2220/40* (2013.01); *F05D 2230/21* (2013.01); *F05D 2250/51* (2013.01); *F05D 2260/606* (2013.01); *F05D 2270/101* (2013.01)

(58) Field of Classification Search
CPC .. F04D 29/4213; F04D 29/444; F04D 29/441; F04D 29/663; F04D 17/10; F04D 25/024; F04D 27/0207; F05D 2220/40; F05D 2270/101; F05D 2260/606; F05D 2250/51; F05D 2230/21; Y10S 415/914
USPC ..... 415/58.4
See application file for complete search history.

(56) References Cited

U.S. PATENT DOCUMENTS

| | | | | |
|---|---|---|---|---|
| 2004/0009061 | A1 | 1/2004 | McDonald | |
| 2004/0096316 | A1 | 5/2004 | Simon et al. | |
| 2006/0156723 | A1 | 7/2006 | Tonetti et al. | |
| 2007/0271921 | A1 | 11/2007 | Chen | |
| 2009/0263234 | A1 | 10/2009 | Yin | |
| 2011/0048003 | A1* | 3/2011 | Chen | F04D 25/04 60/605.2 |
| 2011/0085902 | A1 | 4/2011 | Yin et al. | |
| 2012/0124994 | A1* | 5/2012 | Hommes | F04D 29/023 60/605.1 |
| 2015/0192133 | A1 | 7/2015 | An et al. | |
| 2015/0192147 | A1 | 7/2015 | An et al. | |

FOREIGN PATENT DOCUMENTS

| | | | |
|---|---|---|---|
| CN | 102428282 | A | 4/2012 |
| CN | 202280642 | U | 6/2012 |
| EP | 2 299 121 | A2 | 3/2011 |
| JP | 57-66229 | U | 4/1982 |
| JP | 60-190942 | U | 12/1985 |
| JP | 62-178799 | A | 8/1987 |
| JP | 6-147195 | A | 5/1994 |
| JP | 11-173153 | A | 6/1999 |
| JP | 11-351198 | A | 12/1999 |
| JP | 2004-44576 | A | 2/2004 |
| JP | 2005-23792 | A | 1/2005 |
| JP | 2006-2650 | A | 1/2006 |
| JP | 2006-189049 | A | 7/2006 |
| JP | 2006-342682 | A | 12/2006 |
| JP | 2009-167938 | A | 7/2009 |
| JP | 4464661 | B2 | 5/2010 |
| JP | 2010-270641 | A | 12/2010 |
| JP | 2012-184751 | A | 9/2012 |
| WO | WO 2007/140156 | A1 | 12/2007 |
| WO | WO 2011/044344 | A2 | 4/2011 |
| WO | WO 2014/030248 | A1 | 2/2014 |
| WO | WO 2014/033878 | A1 | 3/2014 |

OTHER PUBLICATIONS

Decision to Grant a Patent effective Nov. 17, 2016, issued in the corresponding JP Application No. 2015-501202 with an English translation.

Office Action dated Mar. 31, 2017, issued in the corresponding EP Application No. 13875422.1.

International Preliminary Report on Patentability and Written Opinion of the International Searching Authority (Forms PCT/IB/338, PCT/IB/326, PCT/IB/373 and PCT/ISA/237), dated Sep. 3, 2015, for International Application No. PCT/JP2013/054613, with an English translation of the Written Opinion.

International Search Report (Form PCT/ISA/220 and PCT/ISA/210), dated Apr. 16, 2013, for International Application No. PCT/JP2013/054613.

Extended European Search Report dated Dec. 21, 2015 issued in corresponding EP Application No. 13875422.1.

* cited by examiner

CENTRIFUGAL COMPRESSOR

TECHNICAL FIELD

This invention relates to a centrifugal compressor including an impeller rotated by a rotational shalt, and more particularly relates to a centrifugal compressor installed in an exhaust turbocharger.

BACKGROUND

Exhaust turbochargers have been widely known which improve an output of an engine used in automobiles and the like. More specifically, the exhaust turbocharger rotates a turbine with energy of exhaust gas from the engine, and compresses intake air with a centrifugal compressor directly connected to the turbine through a rotational shaft and supplies the resultant air into the engine.

A normal compressor in a performance comparison graph in FIG. 18 defined by a pressure ratio as a vertical axis and a flow rate as a horizontal axis represents the compressor (centrifugal compressor) of such an exhaust turbocharger. The compressor is stably operated in a flow rate range from a surge flow rate (a line on the left side in the diagram) at which surging as pulsation of the system as a whole occurs, and a choking flow rate (a line on the right side in the diagram) where choking occurs and the flow rate does not increase any further.

In a centrifugal compressor of a normal compressor type involving direct intake of air into the impeller, the flow rate range, between the coking flow rate and the surge flow rate, ensuring the stable operation is small. Thus, there is a problem in that the compressor needs to be operated at a low operation point which is far from the surge flow rate and thus leads to a low efficiency, to prevent the surging from occurring due to transient change during sudden acceleration.

To solve the problem, the following techniques have been developed. Specifically, guide vanes which generate a swirling flow of intake air are disposed on the upstream side of the impeller in the centrifugal compressor to increase the operation range of the exhaust turbocharger. Furthermore, the intake gas taken into the impeller is partially recirculated to the upstream side of the impeller in a housing of the supercharger to increase the operation range of the exhaust turbocharger.

The technique of providing a recirculation flow path to prevent the distal end side of the impeller leading edge from separating at the time of small flow rate operation involves a flow of air flowing over the impeller at a flow inlet of the recirculation flow path even at a maximum efficiency point at which the flow rate needs not to be improved, and thus the efficiency is degraded. As a result, the pressure ratio drops at a portion other than a low-flow-rate side (refer to the characteristics of a recirculation compressor in FIG. 18).

A technique, such as that in Patent Document 1 (Japanese Patent Application Laid-open No. 2005-23792) for example, has been further developed in which the operating range is increased by a combination of the recirculation flow path and the guide vanes, generating the swirling flow of the intake air, on the upstream side of the impeller.

The technique in Patent Document 1 is briefly described based on FIG. 19.

FIG. 19 shows the disclosed configuration including: guide vanes 03 disposed in an annular air chamber 01 disposed in a shroud portion; a circulation flow path 09 communicating with an intake communication path 05 open at a portion between a portion on the upstream side of the impeller and a portion in the vicinity of an impeller leading edge so that the compressed air can be introduced, and communicating with a discharge communication path 07 open on an intake port side on a portion on the upstream side of the impeller so that the compressed air can be discharged; and an air flow swirling mechanism 013 which is disposed at a portion of the flow path more on the upstream side than the discharge communication path 07 and swirls the air flow flowing into a rotating impeller 011 in the same direction as the impeller 011 and can adjust the swirling amount.

CITATION LIST

Patent Literature

Patent Document 1: Japanese Patent Application Laid-open No. 2005-23792

SUMMARY

Technical Problem

The conventional technique shown in FIG. 19 swirls the air flow, flowing into the rotating impeller 011, in the same direction as the impeller 011 in the flow path more on the upstream side than the discharge communication path 07. Furthermore, the swirling can be adjusted to be larger or smaller by controlling an angle of guide vanes 015 in the air flow swirling mechanism 013.

Thus, the operating range can be increased by controlling the performance characteristics of the compressor through adjustment of an angle of the guide vanes 015. However, there are problems in that the compressor becomes large because a complex mechanism is required for making the guide vanes 015 variable, and that a gap is formed between a movable portion and a fixed portion to degrade the compression efficiency.

The guide vanes 015 of the air flow swirling mechanism 013 are provided to generate the swirling flow in the same direction as the rotation direction of the impeller 011. Thus, a low surging flow rate can be achieved on the low-flow-rate side due to a small difference between an impeller leading edge angle and a flow angle and the generation of the circulation flow. However, there are problems of a pressure loss due to the guide vane at the maximum efficiency point on the high-flow-rate side where the flow rate needs not to be improved, and a large degradation of efficiency and pressure due to a flow of air flowing over the impeller at the flow inlet of the circulation flow path.

In this regard, it is an object to provide a centrifugal compressor which can be stably operated in a wide range by increasing an operating range on a low-flow-rate side and on a high-flow-rate side, with a simple structure of combining a recirculation flow path and a reverse swirling flow generation unit including fixed blades, without providing a complicated movable mechanism for a guide vane.

Solution to Problem

To solve the problems described above, the present invention provides a centrifugal compressor including: a housing including: an air intake port open in a direction of a rotational shaft of the centrifugal compressor; and an air intake path connected to the air intake port; an impeller which is disposed in the housing and compresses intake gas flowed in through the air intake port, the impeller being rotatable about the rotational shaft; a reverse swirling flow generation unit which is disposed between the air intake port and the impeller in the housing, and generates a swirling flow of the intake gas, flowed in through the air intake port, in a direction opposite to a rotation direction of the impeller; and a recirculation flow path which communicates between an outer circumferential portion of the impeller with the air intake path on an upstream side of the impeller. The reverse swirling flow generation unit includes a reverse swirling fixed blade which generates a swirling flow at a predetermined angle with respect to the direction opposite to the rotation direction of the impeller.

According to the present invention, a reverse swirling flow is generated with air as intake gas flowed in through the air intake port. Thus, a low surge flow rate is achieved and thus a surge margin is improved on the low-flow-rate side, and the pressure ratio is improved on the high-flow-rate side, whereby the operating range can be increased.

More specifically, the amount of circulation flow circulating through the recirculation flow path is determined based on a pressure difference between the flow inlet and the flow outlet, and a higher improving effect can be achieved with a larger amount of the circulation flow. The reverse swirling flow increases a load applied to an impeller inlet distal end portion so that the pressure at the flow inlet rises, whereby the amount of the circulation flow increases. As a result, a low surge flow rate can be achieved whereby the surge margin is improved.

When the swirling in the direction opposite to the rotation direction of the impeller is generated, the load applied to the impeller increases on the high-flow-rate side, whereby the work amount of the impeller increases and an improved pressure ratio can be achieved. Thus, even though the efficiency degrades due to the reverse swirling flow generation unit and the recirculation flow path, the improvement of the pressure ratio overwhelms such a negative influence.

The reverse swirling flow generation unit has a simple structure of including only the reverse swirling fixed blade, which generates the reverse swirling flow at a predetermined angle. Thus, the problems that the compressor becomes large due to a complex structure such as a variable vane mechanism and that the compression efficiency degrades due to a gap formed between the movable portion and the fixed portion can be solved. Thus, the compressor can have an improved efficiency and be downsized to be more easily installed in a vehicle.

In present invention, a tilt angle of a downstream end of the reverse swirling fixed blade is preferably set to be a predetermined angle within a range of 5° to 45° with respect to the direction opposite to the rotation direction of the impeller.

FIG. 3 is a graph showing a relationship between the tilt angle of the reverse swirling fixed blade and the operating range of the compressor. To achieve an operating range of a predetermined size larger, the tilt angle is preferably set to be within the range of 5° to 45° with respect to the direction opposite to the rotation direction of the impeller and more preferably set to be within a range of 10° to 20°.

The effect of the reverse swirling flow, that is, load increase at the blade leading edge portion of the impeller cannot be achieved with the tilt angle θ smaller than 5°. When the tilt angle is larger than 45°, a load on the blade leading edge portion of the impeller is so large that it can cause what is known as stalling.

In the present invention, the reverse swirling fixed blade preferably includes: a plurality of guide vanes which are attached to an inner circumferential wall of the air intake path, are disposed along a circumferential direction, and radially extend in a radial direction of the air intake path; and an inner cylindrical member which is provided to connect between inner circumference end portions of the plurality of guide vanes. A center intake flow path is preferably formed in the inner cylindrical member.

With the center intake flow path formed in the inner cylindrical member on an inner circumference side of the guide vanes, flow resistance against the intake air can be reduced, and thus a choking flow rate (maximum flow rate) can be prevented from reducing. With this mechanism, a large operation range of the compressor can be achieved.

In the present invention, the reverse swirling fixed blade is preferably provided at a portion of the air intake path on the upstream side of a flow outlet of the recirculation flow path. With such a configuration, the reverse swirling flow can be formed over the entire air intake path.

In the reverse swirling fixed blade is preferably disposed at a portion of the air intake path between a flow inlet and a flow outlet of the recirculation flow path. With such a configuration, the circulation flow returning through the recirculation flow path also passes through the reverse swirling fixed blade, whereby the generation of the reverse swirling flow is guaranteed and the effect of the reverse swirling flow can be increased.

In the present invention, the reverse swirling fixed blade and the recirculation flow path are preferably formed as an integral structure. With the integral structure of the reverse swirling fixed blade and the recirculation flow path, the structure formed by the reverse swirling fixed blade and the recirculation flow path can be simplified, whereby the number of assembling steps and the manufacturing cost can be reduced. The integral structure is preferably formed by integrally molding a resin material or a casting material (casting iron).

In the present invention, a strut or a protrusion is preferably disposed in the recirculation flow path, the strut or the protrusion changing a flow direction of a circulation flow to the direction opposite to the rotation direction of the impeller.

In the vicinity of the flow inlet of the recirculation flow path, the circulation flow from the impeller includes swirling components in the direction which is the same as the rotation direction of the impeller.

For this reason, with the strut or the protrusion, changing the flow direction of the circulation flow to the direction opposite to the rotation direction of the impeller, disposed in the recirculation flow path, the swirling components in the same direction as the impeller can be reduced. Thus, the swirling flow in the opposite direction to the impeller can be easily formed when the air flow flows into the impeller again after discharging through the flow outlet of the recirculation flow path, whereby the effect of the reverse swirling flow can be increased.

In the present invention, a strut extending along the direction of the rotational shaft is preferably disposed in the recirculation flow path, and 5 to 20 or preferably 10 to 15 of the protrusions are preferably disposed along the circumferential direction.

Generally, about three struts are arranged at an equal interval to hold the cylindrical member and form the recirculation flow path. When 5 to 20 struts, more preferably, 10 to 15 struts are arranged, a smaller swirling component in the same direction as the impeller can be achieved.

As a result, the swirling flow in the opposite direction to the impeller can be easily formed when the air flow flows into the impeller again after discharging through the flow outlet of the recirculation flow path, whereby the effect of the reverse swirling flow can be increased. Thus, a higher operating range increasing effect can be achieved.

Preferably, the reverse swirling fixed blade, the recirculation flow path, and the strut or the protrusion disposed in the recirculation flow path are formed as an integral structure.

With the integral structure of the reverse swirling fixed blade, the recirculation flow path, and the strut or the protrusion disposed in the recirculation flow path, the structure of the portion including the reverse swirling fixed blade and the recirculation flow path is simplified, whereby the number of assembling steps and the manufacturing cost can be reduced. The integrated structure may be formed by integrally molding a resin material or a casting material (casting iron).

In the present invention, a high pressure air outlet portion is preferably provided at a portion of the air intake path on the upstream or the downstream side of the reverse swirling flow generation unit, the high pressure air outlet portion supplying high pressure air in a swirling direction of the reverse swirling flow.

By thus supplying the high pressure air into the air intake path on the upstream or the downstream side of the reverse swirling flow generation unit, the reverse swirling fixed blade can generate a strong reverse swirling flow or swirling flow. Thus, the higher effect of the reverse swirling flow can be achieved, and the higher effect of increasing the operating range of the compressor can be achieved.

In the present invention, an intake pipe connected to an upstream side of the air intake port is preferably formed of a bent tube so that intake air swirls in a direction of the reverse swirling flow.

When the intake pipe connected to the upstream side of the air intake port is formed of a bent tube for generating the reverse swirling flow, the reverse swirling fixed blade can generate a strong reverse swirling flow or swirling flow. Thus, the higher effect of the reverse swirling flow can be achieved, and the higher effect of increasing the operating range of the compressor can be achieved.

Advantageous Effects

According to the present invention, an operating range of a compressor can be increased on a low-flow-rate side and on a high-flow-rate side and a stable operation can be achieved in a wide range, with a simple structure of combining a recirculation flow path and a reverse swirling flow generation unit including fixed blades, without providing a complicated movable mechanism for guide vane.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Embodiment 1

Figure 1:
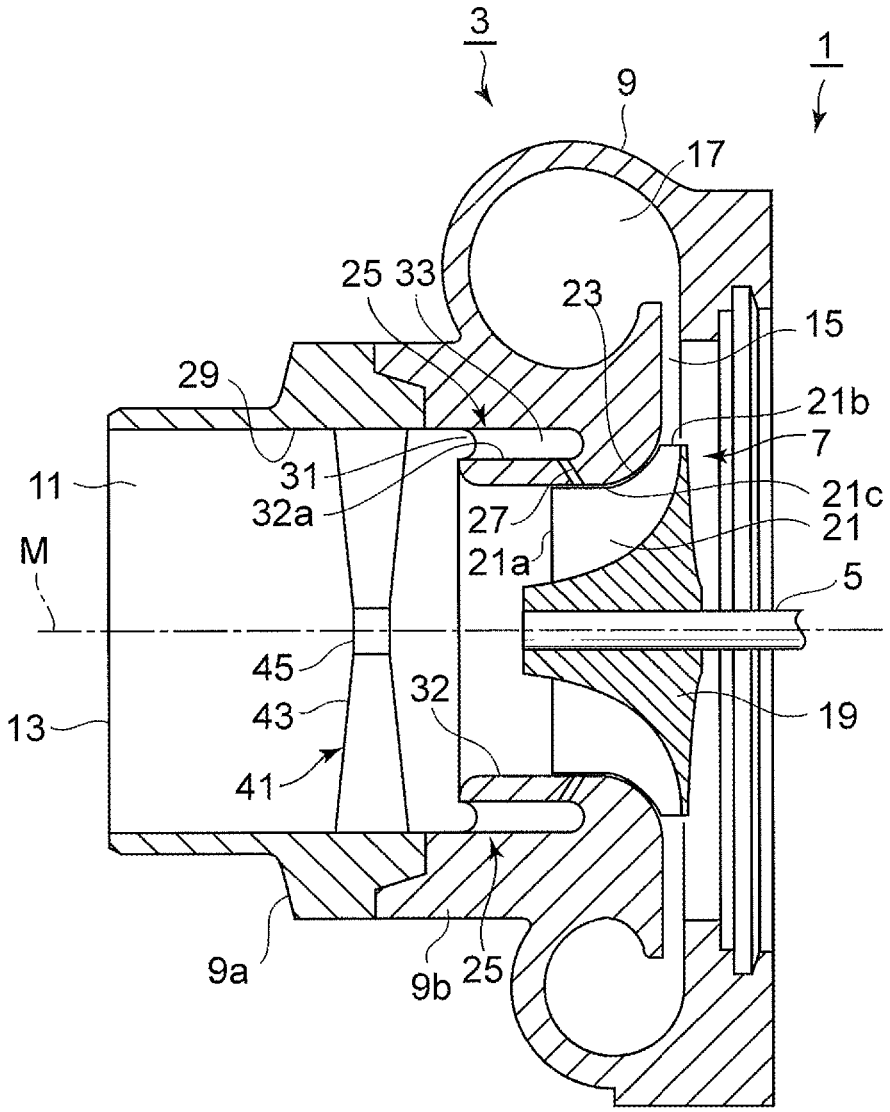
FIG. 1 is a cross-sectional view of a main part in a rotation axis direction according to a first embodiment of the present invention.

FIG. 1 is a cross-sectional view of a main portion of an exhaust turbocharger 1 of an internal combustion engine on a side of a compressor (centrifugal compressor) 3 in a rotation axis direction. Rotational force of an unillustrated turbine rotor, driven by exhaust gas of the internal combustion engine, is transmitted to the compressor 3 of the exhaust turbocharger 1 through a rotational shaft.

In the compressor 3, an impeller 7 is strutted to be rotatable about a rotational axis M of the rotational shaft 5 in a compressor casing 9. An air intake path 11, through which the intake gas such as air for example before being compressed is guided to the impeller 7, coaxially extends in the rotational axis M to have a cylindrical shape. An air intake port 13, connected to the air intake path 11, is formed on an end portion of the air intake path 11.

A diffuser 15, extending in a direction orthogonal to the rotational axis M, is formed on an outer side of the impeller 7. A spiral air path 17 is formed on an outer circumference side of the diffuser 15. The spiral air path 17 forms an outer circumference portion of the compressor casing 9.

The impeller 7 includes a hub 19, drivingly rotated about the rotational axis M, and a plurality of blades (vanes) 21 disposed on an outer circumference surface of the hub 19. The hub 19 is coupled to the rotational shaft 5.

The blade 21 is drivingly rotated to intake air through the air intake port 13 and compress the air which has passed through the air intake path 11. The shape of the blade 21 is not particularly limited. The blade 21 includes: a leading edge 21*a* as an edge portion on an upstream side; a trailing edge 21*b* as an edge portion on a downstream side; and a shroud side (the outer periphery of) 21*c* as an edge portion on an outer side in a radial direction. The shroud side 21*c* is a side edge portion covered with a shroud portion 23 of the compressor casing 9. The shroud side 21*c* is disposed to pass through the vicinity of an inner surface of the shroud portion 23.

The impeller 7 of the compressor 3 is drivingly rotated about the rotational axis M by the rotational driving force of the rotational shaft 5. The external air, taken in through the air intake port 13, flows between the plurality of blades 21 of the impeller 7, and after dynamic pressure has mainly risen, flows into the diffuser 15 on the outer side in the radial direction. Then, the air with pressure, increased due to conversion of part of the dynamic pressure into static pressure, flows through the spiral air path 17 to be discharged. Then, the air is supplied as intake air of the internal combustion engine.

(Recirculation Flow Path)

Next, a recirculation flow path 25, formed in the compressor casing 9, will be described.

The recirculation flow path 25 is formed to communicate between an annular downstream opening 27 and an upstream opening 31. The annular downstream opening 27 is open in the compressor casing 9 at a portion facing the shroud sides 21*c* of the blades 21. The upstream opening 31 is open along an inner peripheral wall 29 at a portion of the compressor casing 9 more on the upstream side than the leading edges 21*a* of the blades 21.

Air immediately after flowing between the blades 21 or in the course of pressurizing process, flows through the recirculation flow path 25 to recirculate into the air intake path 11 on the upstream side of the impeller 7.

The recirculation flow path 25 is formed of an annular path formed between an outer circumference surface 32*a* of a cylindrical member 32 and the inner peripheral wall 29 of the air intake path 11. The cylindrical member 32 is formed on an inner side of the inner peripheral wall 29 of the cylindrical air intake path 11 with a center matching the rotational axis M.

Struts 33, extending in the direction of the rotational axis M, are formed at a plurality of portions arranged at an equal interval along a circumferential direction in the recirculation flow path 25. The strut 33 couples between the outer circumference surface 32*a* of the cylindrical member 32 and the inner peripheral wall 29 of the air intake path 11.

In the compressor casing 9, an upstream housing 9*a* and a downstream housing 9*b* have matching surfaces in forms of a step, and thus are spigot-fitted to be coupled with each other and positioned in the rotational axis M and in the radial direction orthogonal to the rotational axis M.

With the recirculation flow path 25, the following operation is performed.

In a flowrate state in which an appropriate amount of air passed through the compressor 3, as the air passing through the recirculation flow path 25, the air from the air intake port 13 flows from the upstream opening 31 to the downstream opening 27, and flows to the shroud side 21*c* of the blade 21 from the downstream opening 27.

When the amount of air flowing through the compressor 3 is reduced and the flowrate becomes so low to cause surging, the air flows in the opposite direction in the recirculation flow path 25 to flow from the downstream opening 27 to the upstream opening 31 to be reintroduced into the air intake path 11 and into the impeller 7. Thus, apparently, the flow rate of the air flowing to the leading edges 21*a* of the blades 21 can be increased, and a surge flow rate at which the surging occurs can be a low flow rate.

When the recirculation flow path 25 is provided as described above so that the surge flow rate can be a low flow rate, however, at a maximum efficiency point involving a high flow rate, a flow of the air flowing over the shroud sides 21*c* (the outer periphery of) of the blades 21 of the impeller 7 is generated on a flow inlet side which is at the downstream opening 27, and thus the efficiency degrades.

(Reverse Swirling Flow Generation Unit)

A reverse swirling flow generation unit (intake air guide vane) 41 will now be described.

As shown in FIG. 1, the reverse swirling flow generation unit 41 is disposed between the air intake port 13 and the impeller 7 in the air intake path 11 of the upstream housing 9*a*, and generates a swirling flow, in a direction opposite to a rotation direction of the impeller 7, with the flow of air flowed in through the air intake port 13.

The reverse swirling flow generation unit 41 includes: a plurality of guide vanes (reverse swirling fixed blades) 43 which radially extend in the radial directions and are arranged at an equal interval in the circumferential direction on the inner peripheral wall 29 of the upstream housing 9*a*; and a center portion 45 connecting between inner circumference end portions of the plurality of the guide vanes 43.

The reverse swirling flow generation unit 41 is disposed more on the upstream side than the upstream opening 31 of the recirculation flow path 25. Thus, reverse swirling flow can be formed over the entire air intake path 11.

Figure 2:
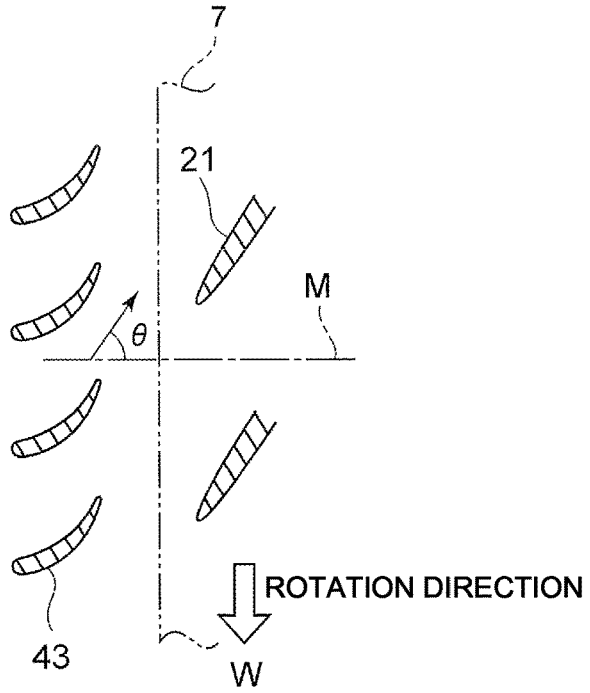
FIG. 2 is an explanatory diagram showing an arrangement relationship between an impeller and reverse swirling fixed blades.
Figure 3:
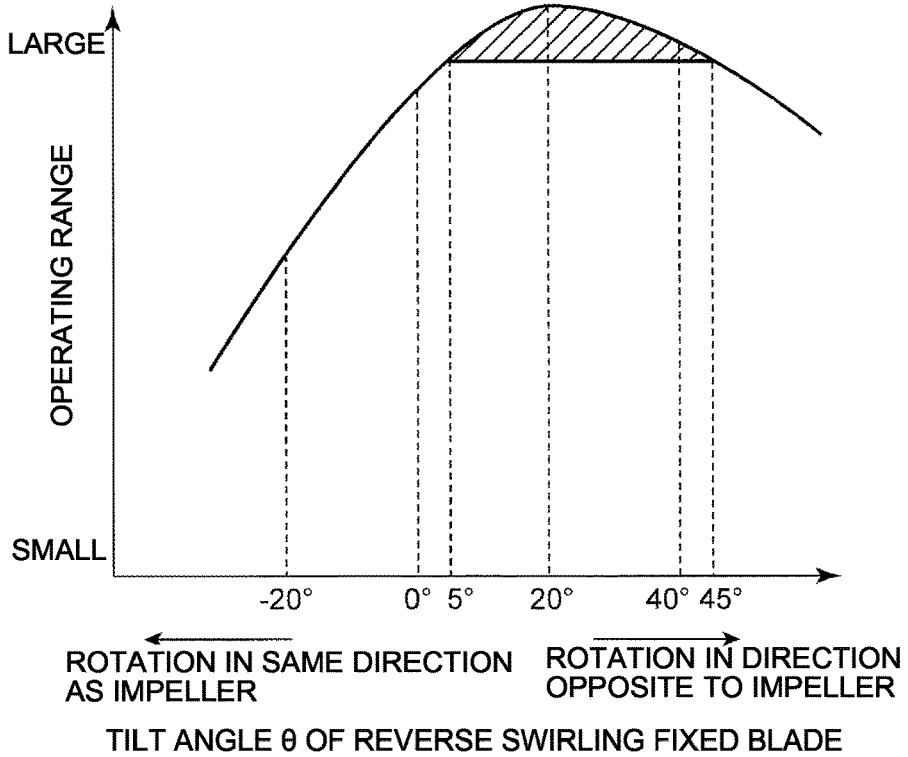
FIG. 3 is a graph illustrating a relationship between a tilt angle of a reverse swirling flow and an operating range of a compressor.

As shown in FIG. 2, the guide vanes 43 are each formed of a thin plate member having a blade shape. A tilt angle θ of the trailing edge of the guide vane 43, that is, an angle of the flow from the trailing edge, is preferably in the range from 5° to 45°, under a condition that the tilt angle θ of the guide vanes 43 in the direction of the rotational axis M being 0° and the tilt angle θ of the guide vanes 43 in a direction orthogonal to a rotational direction M and opposite to the rotation direction of W of the impeller 7 being 90°. The tilt angle θ is especially preferably in a range from 10° to 20°. Load increase at a portion of the leading edges 21*a* of the blades 21 of the impeller 7 cannot be achieved with the tilt angle θ smaller than 5°. When the tilt angle θ is larger than 45°, a load on the portion of the leading edges 21*a* of the impeller 7 is so large that it can cause what is known as stalling and thus fail to achieve an effect of increasing the operating range of the compressor 3 (refer to characteristics in FIG. 3).

Figure 5:
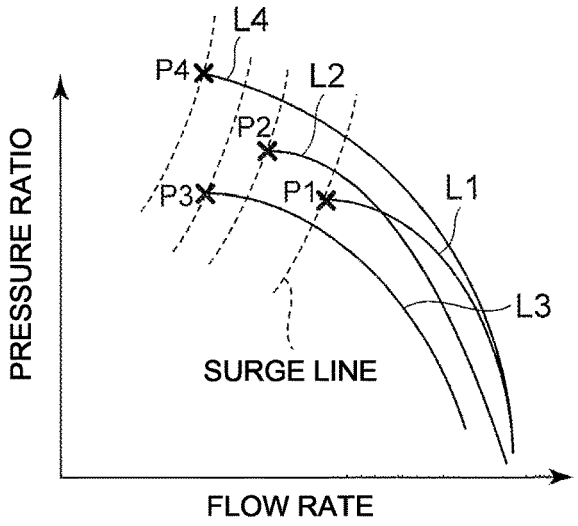
FIG. 5 is a characteristics diagram showing a relationship between a pressure ratio and a flow rate in the first embodiment.

The present invention is based on the idea that, as shown in FIG. 5, a larger operating range can be achieved by generating the swirling flow in a direction opposite to the rotation direction of the impeller 7 on the upstream side of the impeller 7, than by generating the swirling flow in the same direction as the rotation direction of the impeller 7 on the upstream side of the impeller 7.

This is apparent in a characteristic diagram in FIG. 5 illustrating relationships between a pressure ratio and a flow rate. In the figure, a line L1 represents the characteristics of a normal compressor including neither the recirculation flow path nor the swirling flow generation unit, a line L2 represents the characteristics in a case where only the recirculation flow path, a line L3 represents the characteristics in a case where the swirling flow generation unit generates the swirling flow in the direction which is the same rotation direction as the impeller, and a line L4 represents the characteristics in a case where the swirling flow generation unit generates the swirling flow in the direction opposite to the rotation direction of the impeller as in the present invention.

More specifically, when the swirling flow in the direction which is the same rotation direction as the impeller 7 is generated, the surge flow rate can be reduced on a low-flow-rate side due to the increase in the recirculation amount, whereby reduction to a surge point P3 on the line L3 from a surge point P2 on the line L2 representing a case where only the recirculation flow path can be achieved. Still, the line L3 indicates the reduction of the pressure ratio due to the increase in the recirculation amount and the generation of the flow of air flowing over the shroud sides (the outer periphery of) 21*c* of the blades 21 of the impeller 7 on the flow inlet side.

On the other hand, when the swirling flow in the direction opposite to the rotation direction of the impeller 7 is generated, the amount of circulation flow circulated through the recirculation flow path 25 is determined by a pressure difference between the flow inlet and a flow outlet on the low-flow-rate side. A larger amount of circulation flow leads to a higher improvement effect and a lower surge flow rate, whereby the reduction to a surge point P4 on the line L4 can be achieved.

All things considered, the reverse swirling flow increases the load on the side of the leading edges 21*a* of the blades 21 and pressure at the downstream opening 27 as the flow inlet, whereby the pressure difference between the flow inlet and the flow outlet increases so that the amount of circulation flow increases.

Figure 4A:
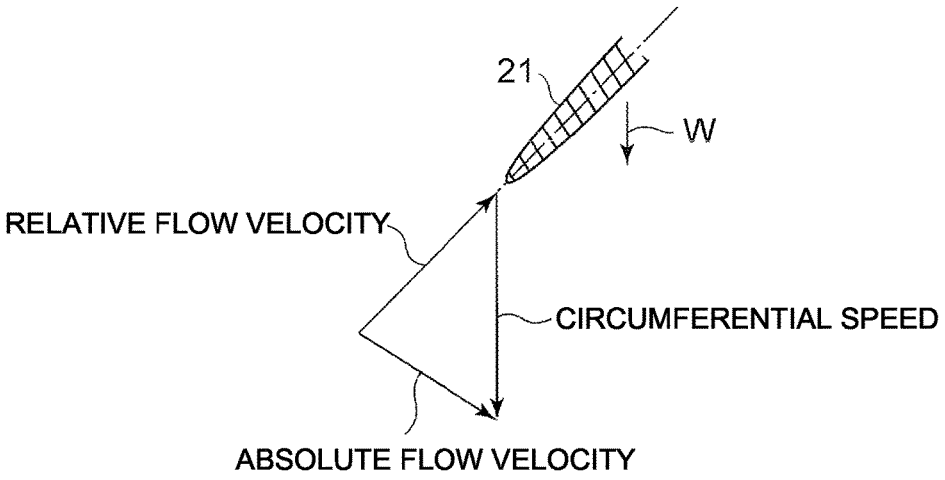
FIG. 4A is an explanatory diagram showing a velocity triangle at an inlet of the impeller in a case involving a swirling flow in a direction opposite to the impeller.
Figure 4B:
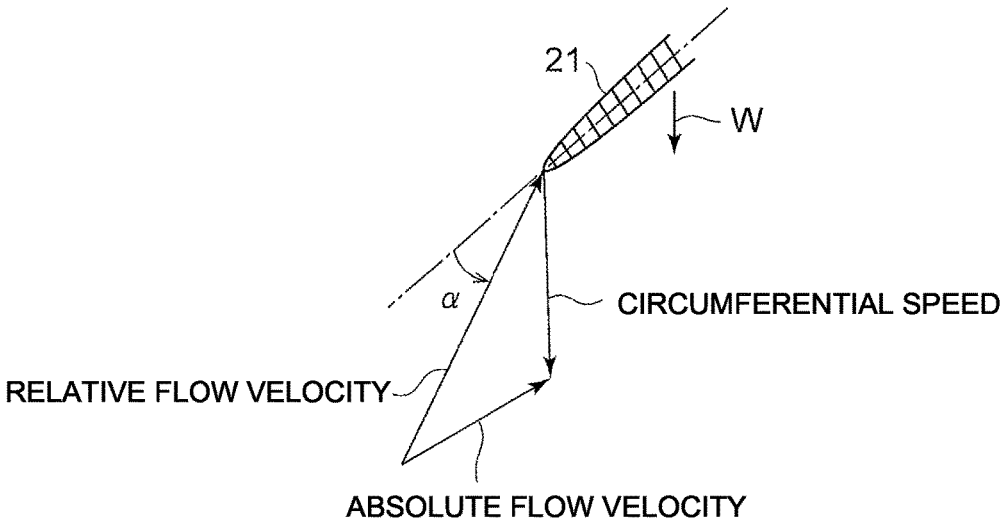
FIG. 4B is an explanatory diagram showing a velocity triangle at the inlet of the impeller in a case involving a swirling flow in the same direction as the impeller.

The load increase is described with reference to FIGS. 4A and 4B. FIG. 4A shows a case of the swirling flow (absolute flow velocity) in the same direction as the rotation direction W of the impeller 7. FIG. 4 B shows a case of the swirling flow (absolute flow velocity) in the direction opposite to the rotation direction W of the impeller 7. As shown in the figures, a relative velocity Vb, of relative velocities Va and Vb acting on the leading edge 21*a* of the blade 21, corresponding to the case of the swirling flow in the reverse direction involves a larger action angle (angle between the center line of the leading edge 21*a* of the blade 21 and the relative velocity) α and a larger load applied to the blade 21, compared with the case of the swirling flow in the same direction. As a result, a large surge flow rate reduction effect can be obtained by the increase in the recirculation amount as described above.

When the swirling in the direction opposite to the rotation direction of the impeller 7 is generated, the load applied to the impeller 7 increases on a high-flow-rate side, whereby the work amount of the impeller 7 increases and an improved pressure ratio can be achieved. Thus, even though the efficiency degrades due to the guide vanes 43 of the reverse swirling flow generation unit 41 and the recirculation flow path 25, the improvement of the pressure ratio overwhelms such a negative influence. Thus, the characteristics represented by the line L4 in FIG. 5 can be achieved.

All things considered, a lager operating range can be achieved on both the low-flow-rate side and the high-flow-rate side, whereby a stable operation can be guaranteed over a wide range.

The reverse swirling flow generation unit 41 has a simple structure of including only the guide vanes (reverse swirling fixed blades) 43, which generates the reverse swirling flow at a predetermined angle. Thus, the problems that the compressor becomes large due to a complex structure such as a variable vane mechanism and that the compression efficiency degrades due to a gap formed between the movable portion and the fixed portion can be solved. Thus, the compressor can have an improved efficiency and be downsized to be more easily installed in a vehicle.

Figure 6A:
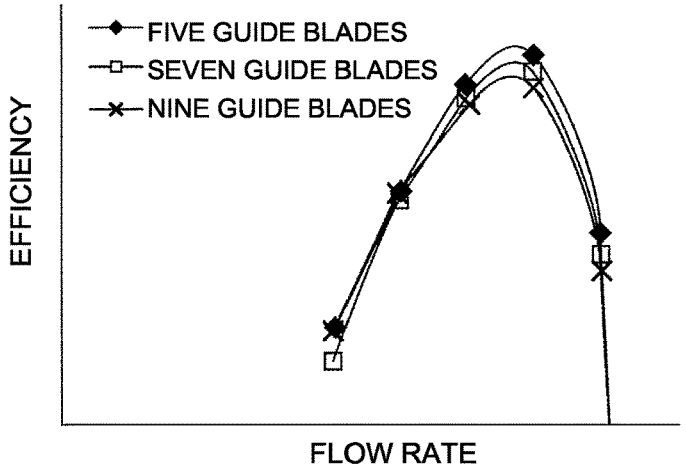
FIG. 6A is an explanatory graph related to a relationship between a flow rate and an efficiency showing flow analysis results regarding the number of reverse swirling fixed blades.
Figure 6B:
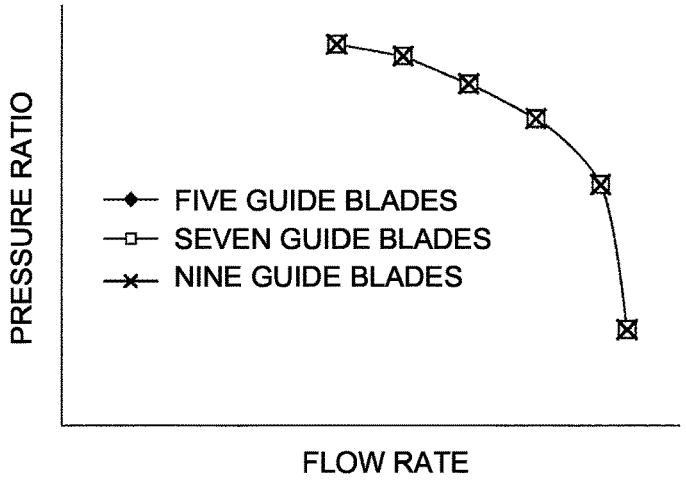
FIG. 6B is an explanatory graph related to a relationship between a flow rate and a pressure ratio showing flow analysis results regarding the number of reverse swirling fixed blades.

The number of guide vanes 43 forming the reverse swirling flow generation unit 41 arranged in the circumferential direction will be described. When the number of blades is large, the velocity of the swirling flow is large and a large operating range can be obtained as described above, but the efficiency of the compressor 3 is low. FIG. 6A shows a relationship between the efficiency and the flow rate and FIG. 6B shows a relationship between the pressure ratio and the flow rate, based on an analysis result. No change has been found among the numbers of blades five to nine in the pressure ratio. However, it has been found that the efficiency degrades as the number of blades increases from five. Thus, it has been found that an appropriate number of blades is five to seven.

Embodiment 2

Figure 7:
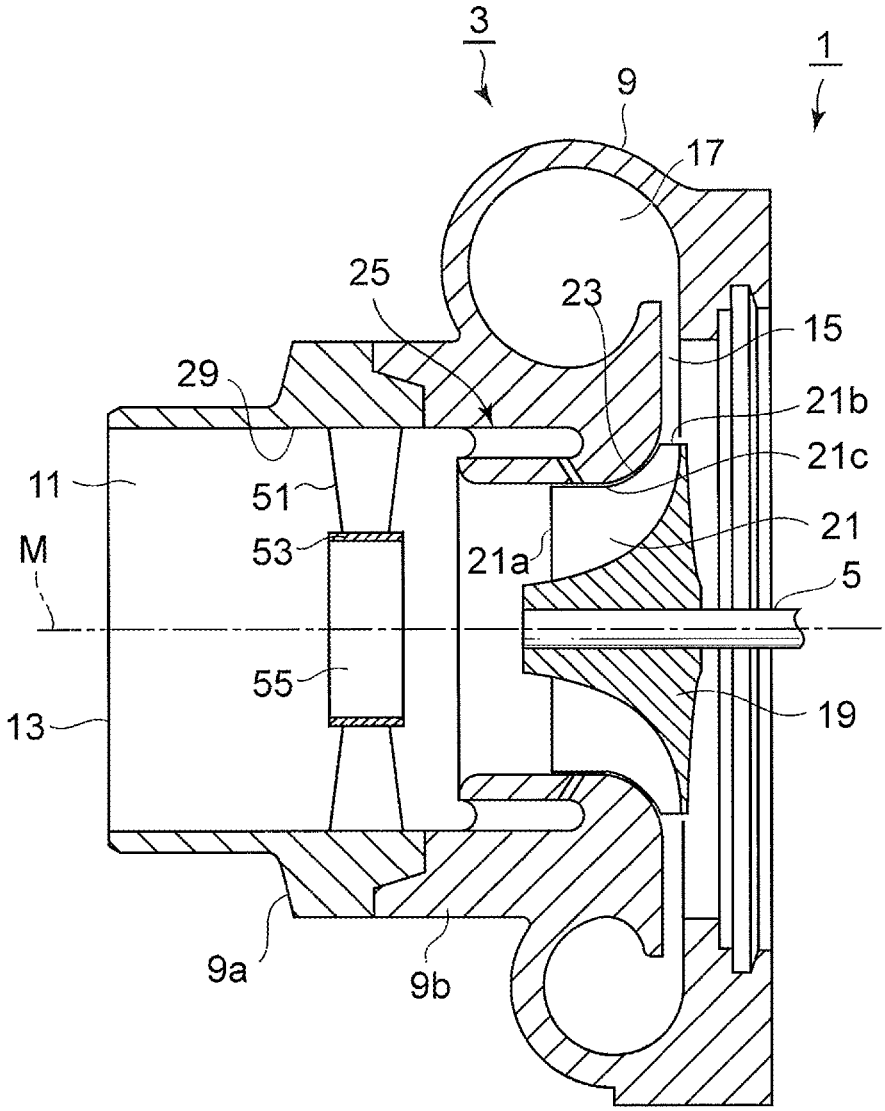
FIG. 7 is a diagram showing a second embodiment according to the present invention featuring a modification of the reverse swirling fixed blades.

With reference to FIG. 7, a second embodiment will now be described.

The second embodiment features a modification of the guide vanes 43 according to the first embodiment. A plurality of guide vanes 51 according to the second embodiment radially extend in the radial directions and are attached on the inner peripheral wall 29 of the upstream housing 9*a*, at an equal interval in the circumferential direction. An inner cylindrical member 53 is further provided which connects between inner circumference end portions of the plurality of the guide vanes 51.

With the guide vanes 51, fixed blades for reverse swirling are formed, and a center intake flow path 55 is formed through which air, which has flowed into the inner side of the inner cylindrical member 53 from the air intake port 13, flows toward the impeller 7 in the direction of the rotational axis M. The inner cylindrical member 53 is formed to have an outer diameter larger than a joint position between the leading edges 21*a* of the blades 21 and the upper surface of the hub 19.

With the center intake flow path 55 formed on an inner circumference side of the guide vanes 51, flow resistance against the intake air can be reduced, and thus a choking flow rate (maximum flow rate) can be prevented from reducing. All things considered, a large operating range of the compressor 3 can be achieved.

The other configuration and the operation and effects are the same as those in the first embodiment.

Embodiment 3

Figure 8:
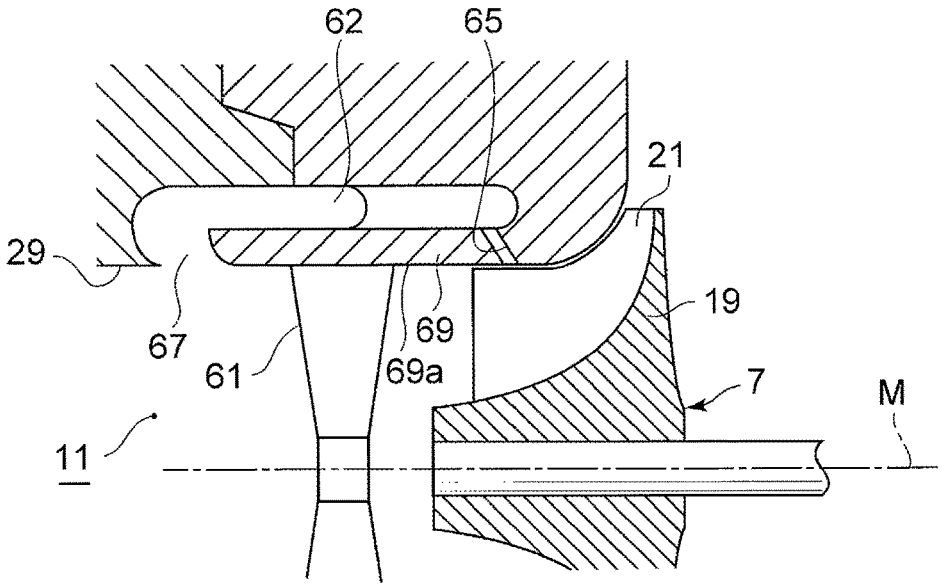
FIG. 8 is a diagram showing a third embodiment according to the present invention featuring a modification of the reverse swirling fixed blades.

With reference to FIG. 8, a third embodiment will now be described.

The third embodiment features a modification of the guide vanes 43 according to the first embodiment.

In the first embodiment, the guide vanes 43 are formed at a portion in the air intake path 11 more on the upstream side than the upstream opening 31 as the flow outlet of the recirculation flow path 25. In the third embodiment, guide vanes 61 are disposed at a portion of the air intake path 11 between a downstream opening 65 as the flow inlet of a recirculation flow path 62 and an upstream opening 67 as the flow outlet.

The guide vanes 61 extend in the radial directions of the air intake path 11 and are attached on an inner peripheral wall 69*a* of a cylindrical member 69 forming the cylindrical member 69 formed in the inner peripheral wall 29, at an equal interval in the circumferential direction. A center portion 71 is further provided which connects between inner circumference end portions of the plurality of the guide vanes 61. The center portion 71 may be an inner cylindrical member as in the second embodiment.

With the configuration according to the third embodiment, the circulation flow, returning to the air intake path 11 through the recirculation flow path 62, also passes through the guide vanes 61 so that the swirling in the direction opposite to the rotation direction of the impeller 7 is generated. Thus, the reverse swirling flow can be surely generated, whereby the load on the impeller 7 can be increased and a larger effect of increasing the operation range of the compressor 3 can be achieved.

Embodiment 4

Figure 9:
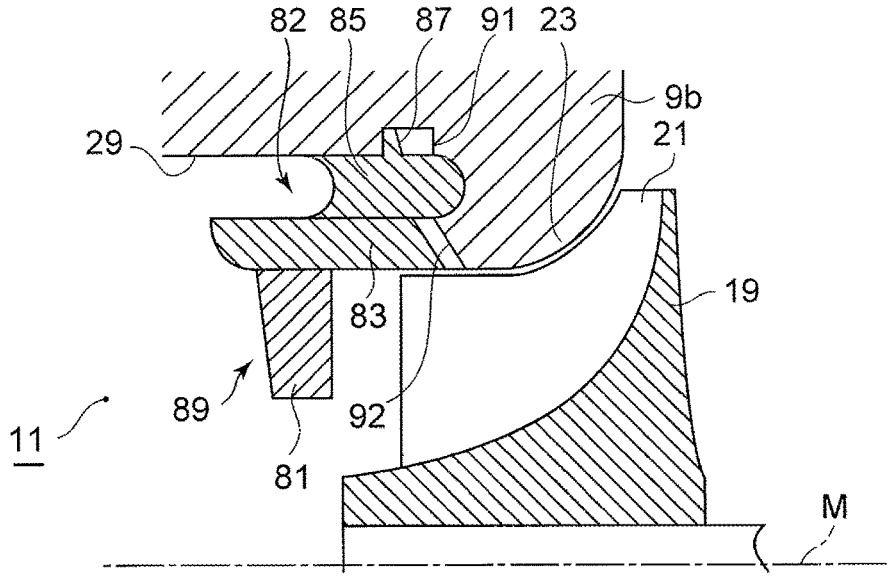
FIG. 9 is a cross-sectional view of a main part in a rotation axis direction showing a fourth embodiment of the present invention featuring an integral structure of the reverse swirling fixed blades and a recirculation flow path.
Figure 10:
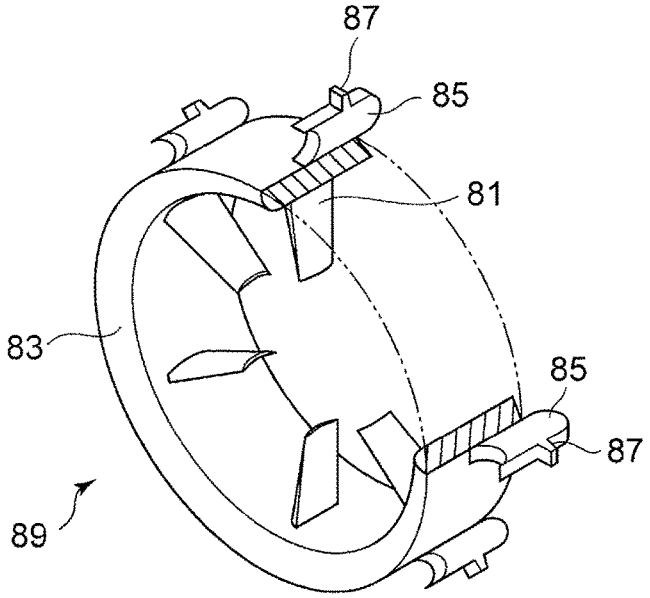
FIG. 10 is a partially cutout schematic perspective view according to the fourth embodiment.

With reference to FIGS. 9 and 10, a fourth embodiment will now be described.

The fourth embodiment features a structure in which guide vanes 81 and a cylindrical member 83, forming a recirculation flow path 82, are formed as an integral structure.

FIG. 9 is a cross-sectional view of a main portion in the rotation axis direction. FIG. 10 is a partially cutout schematic perspective view. Struts 85, extending in the rotational axis M, and protruding on an outer circumference surface of the cylindrical member 83 forming the recirculation flow path 82 are arranged at an equal interval. A stopper portion 87 for positioning protrudes from a distal end portion of the strut 85 in the radial direction.

A plurality of the guide vanes 81 radially extending in radial directions are attached on the inner peripheral wall 83*a* of the cylindrical member 83 at an equal interval. The cylindrical member 83, the struts 85, and the guide vanes 81 are integrally formed, whereby a reverse swirling fixed blade unit 89 is formed. The reverse swirling fixed blade unit 89 is integrally formed of a resin material or a casting material such as casting iron.

In the fourth embodiment, the reverse swirling fixed blade unit 89 is attached by being inserted from the side of the air intake port 13 along the inner peripheral wall 29 of the air intake path 11 until the stopper portions 87 for positioning engage with ring grooves 91 formed on the downstream housing 9*b*. Whereby the reverse swirling fixed blade unit 89 including the guide vanes 81 can be easily assembled while a downstream opening 92 and the recirculation flow path 82 are formed.

A fixing unit such as an unillustrated bolt may be used for fixing or may not be provided because the reverse swirling fixed blade unit 89 does not receive large external force. In the latter case, the fixing may be achieved by the engagement between the stopper portions 87 and the ring grooves 91 only.

Thus, the recirculation flow path 82 and the guide vanes 81 can have simple structures, whereby the manufacturing cost and the number of assembling steps can be reduced.

Embodiment 5

Figure 11:
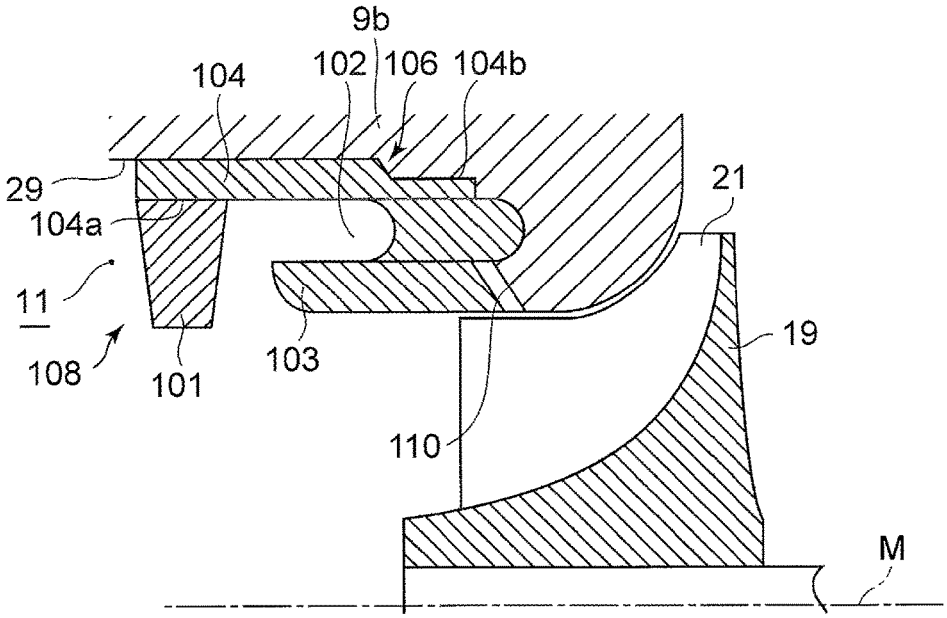
FIG. 11 is a cross-sectional view of a main part in the rotation axis direction showing a fifth embodiment of the present invention.

With reference to FIG. 11, a fifth embodiment will now be described.

The fifth embodiment features a structure of the guide vanes (reverse swirling fixed blades) which is similar to the fourth embodiment. More specifically, guide vanes 101, an inner cylindrical member 103 forming a recirculation flow path 102, and an outer cylindrical member 104 are formed as an integral structure.

As shown in FIG. 11, the recirculation flow path 102 is formed between an outer circumference surface of the inner cylindrical member 103 and an inner circumference surface of the outer cylindrical member 104. A plurality of the guide vanes 101 are arranged in a circumferential direction on an inner circumference wall one end portion 104*a* of the outer cylindrical member 104. A step portion 106 is formed on an outer circumference wall other end portion 104*b* of the outer cylindrical member 104. Thus, a reverse swirling fixed blade unit 108 is formed. The reverse swirling fixed blade unit 108 is integrally formed of a resin material or a casting material.

The reverse swirling fixed blade unit 108 is attached to the inner peripheral wall 29 of the air intake path 11 by being inserted and fit until the step portion 106 of the reverse swirling fixed blade unit 108 engages with a step portion 109 formed in the downstream housing 9*b*.

Thus, the guide vanes 101 can be easily formed while a downstream opening 110 and the recirculation flow path 102 are formed.

All things considered, a structure including the recirculation flow path 102 and the guide vanes 101 can be simplified, whereby the manufacturing cost and the number of assembling steps can be reduced.

Embodiment 6

With reference to FIGS. 12 to 14D, a sixth embodiment will now be described.

The sixth embodiment features a shape and the number of struts or protrusions formed in the recirculation flow path in the embodiments.

Figure 12:
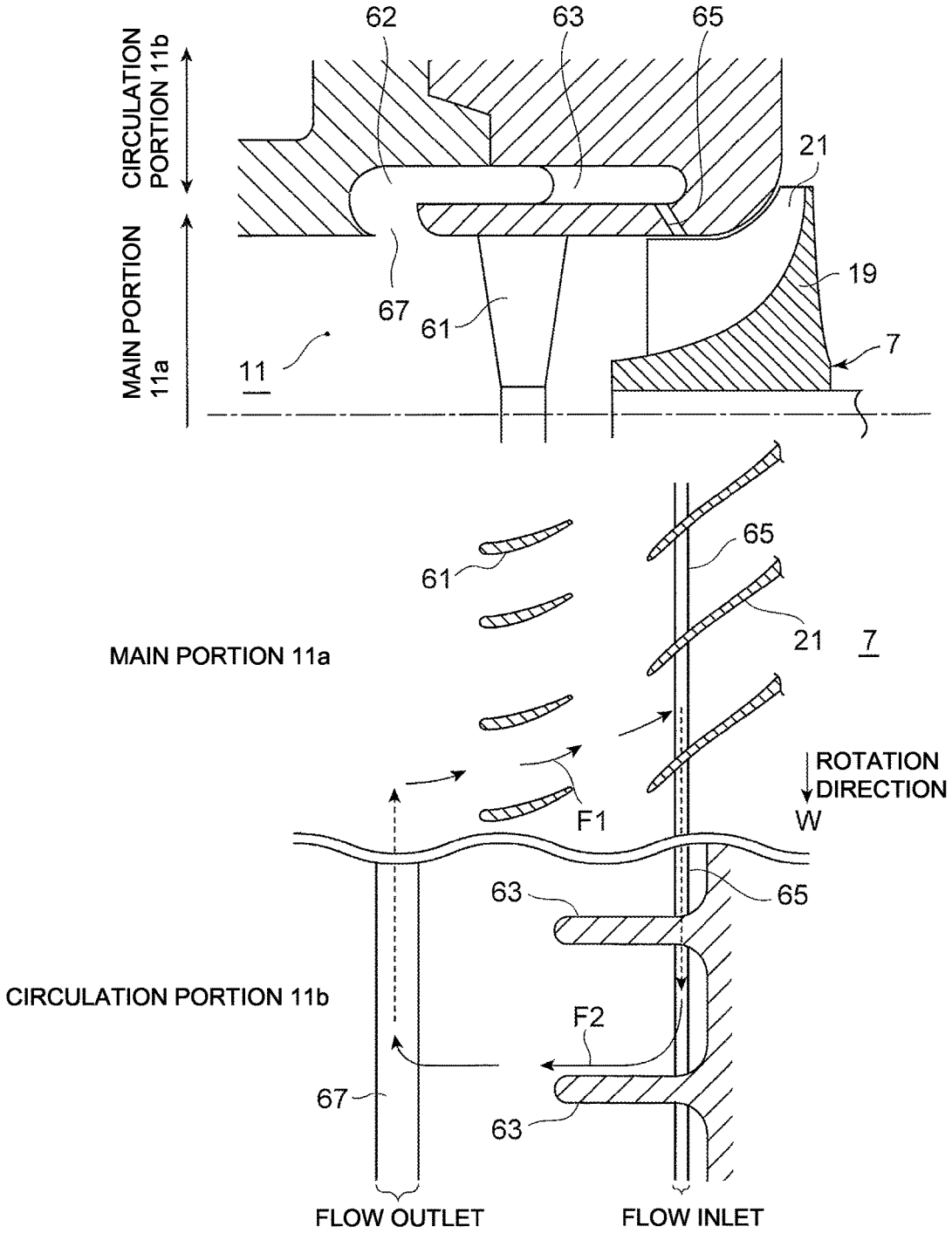
FIG. 12 is an explanatory diagram showing a sixth embodiment of the present invention.

A description is given with reference to FIG. 12, based on the configuration of the recirculation flow path 62 according to the third embodiment shown in FIG. 8.

A flowing state of air in a main portion 11*a* in which the air intake path 11 is formed and a circulation portion 11*b* in which the recirculation flow path 62 is described with reference to FIG. 12 as an explanatory diagram as a developed plan view of a flow path, the guide vanes 61, and the blade 21. In the figure, the main portion 11*a* and the circulation portion 11*b* are respectively shown in upper and lower portions.

As shown in FIG. 12, an air flow F1 in the main portion 11*a* is swirled by the guide vanes 61 in a direction opposite to the rotation direction of W of the impeller 7, and flows between the blades 21, to be taken in through the downstream opening 65 as the flow inlet of the recirculation flow path 62.

The recirculation flow F2 thus taken in and flows into the recirculation flow path 62 is a swirling flow in the direction which is the same as the rotation direction of W of the impeller 7. The struts 63 shift the swirling flow to be in the direction of the rotational axis M to flow into the upstream opening 67 as the low outlet. Thereafter, the flow is blown into the air intake path 11 to join the main flow to then flow into the guide vanes 61 again.

The plurality of struts 63 are arranged at an equal interval in the circumferential direction. Generally, about three struts 63 are arranged to hold the cylindrical member 69 and form the recirculation flow path 62.

When 5 to 20 struts 63 are arranged, swirling components in the same direction as the impeller 7 can be reduced As a result, the guide vanes 61 can easily generate the swirling flow in the direction opposite to the rotation direction of W of the impeller 7 the air flows between the guide vanes 61 again. Thus, a higher operating range increasing effect can be achieved.

Figure 13:
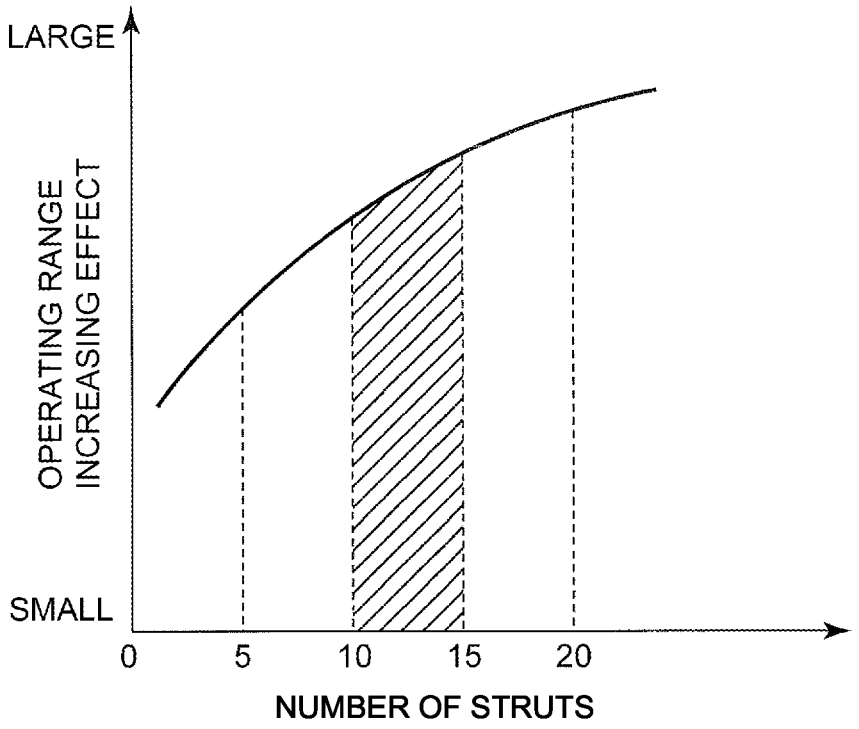
FIG. 13 is an explanatory diagram illustrating a relationship between the number of struts and an operating range increasing effect.

FIG. 13 shows a relationship between the number of arranged struts 63 and the operating range increasing effect. As shown in FIG. 13 the following facts have been found. More specifically, the higher effect can be achieved with a larger number of struts 63. At least five struts 63 needs to be arranged to achieve a smaller swirling components in the same direction as the impeller 7 in the recirculation flow path 62. However, when there are too many struts 63, a contact area between a mold and the product is large, and the mold wears fast. Thus, through trial and error, it has been found that an appropriate number of arranged struts 63 is 5 to 20 and is preferably 10 to 15.

Next, with reference to FIGS. 14A to 14D, a modification of the strut 63 and a shape of guide vanes 120 which are disposed on a bottom surface of the recirculation flow path 62 and rectifies the flow to the upstream opening 67 as the flow outlet will be described.

Figure 14A:
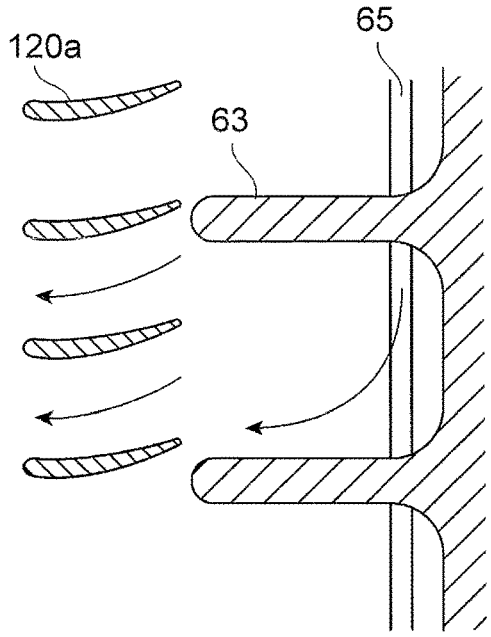
FIG. 14A is a diagram showing a modification of the sixth embodiment.

In FIG. 14A, the struts 63 extend in the direction of the rotational axis M. The struts 63 and the guide vanes 120*a* work together to reduce the swirling components in the same direction as the rotation direction of W of the impeller 7 and increase components in the direction of the rotational axis M.

Figure 14B:
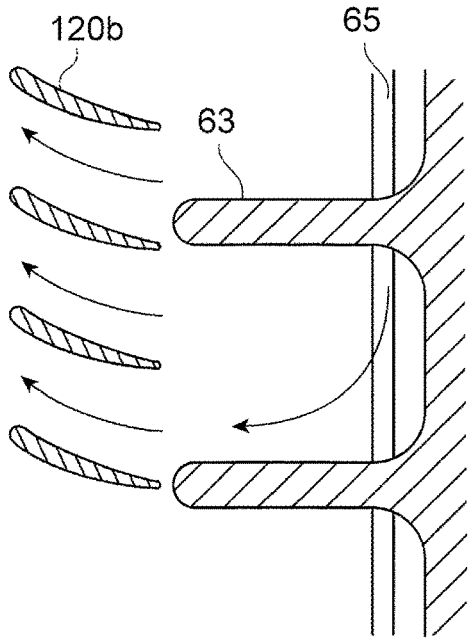
FIG. 14B is a diagram showing a modification of the sixth embodiment.

In FIG. 14B, the struts 63, extending in the direction of the rotational axis M, reduce the swirling components in the same direction as the rotation direction of W of the impeller 7 and increases the components in the direction of the rotational axis M. Furthermore, the guide vanes 120*b* generate components in the direction opposite to the rotation direction of the impeller 7.

Figure 14C:
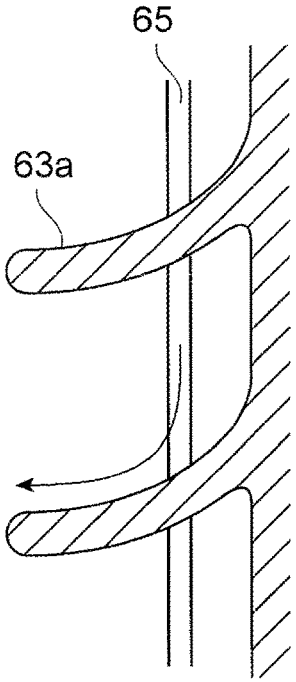
FIG. 14C is a diagram showing a modification of the sixth embodiment.

In FIG. 14C, struts 63*a* each have a curved shape so that the components in the direction of the rotational axis M are increased by the flow along the shape of the strut 63*a*.

Figure 14D:
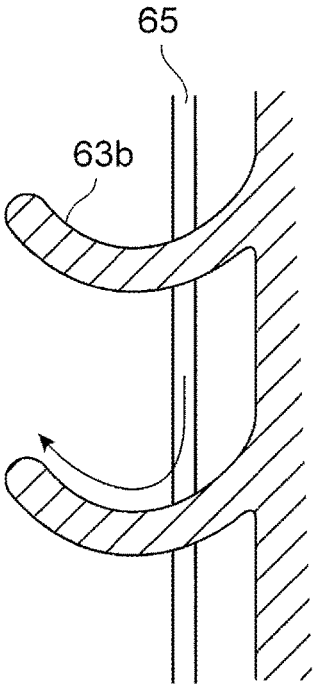
FIG. 14D is a diagram showing a modification of the sixth embodiment.

In FIG. 14D, struts 63*d* each have a curved shape so that the components in the direction opposite to the impeller 7 are generated by the flow along the shape of the strut 63*d*.

According to the sixth embodiment, the strut 63, 63*a*, and 63*b* and the guide vanes 120*a* and 120*b* provide an effect of reducing the swirling components, in the same direction as the impeller 7, of the recirculation flow flowing in the recirculation flow path and/or generating the components in the direction opposite to the impeller 7. Thus, the swirling flow in the direction opposite to the impeller 7 can be more easily generated in the air flow flowing into the guide vanes 61 again after returning to the main flow, whereby the operating range increasing effect can be obtained.

It is a matter of course that the struts and the guide vanes according to the sixth embodiment can be integrally formed as in the fourth and the fifth embodiments to achieve a simple structure with which the manufacturing steps and the manufacturing cost can be reduced.

Embodiment 7

Figure 15:
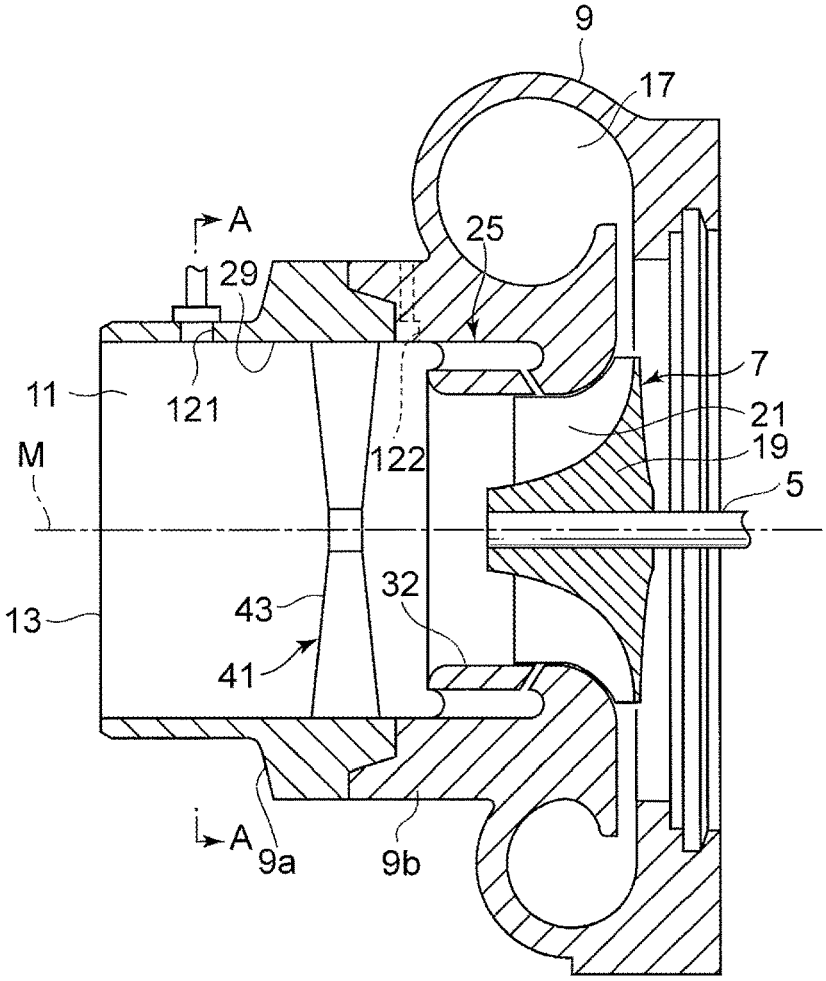
FIG. 15 is a cross-sectional view of a main part in the rotation axis direction showing a seventh embodiment of the present invention.
Figure 16:
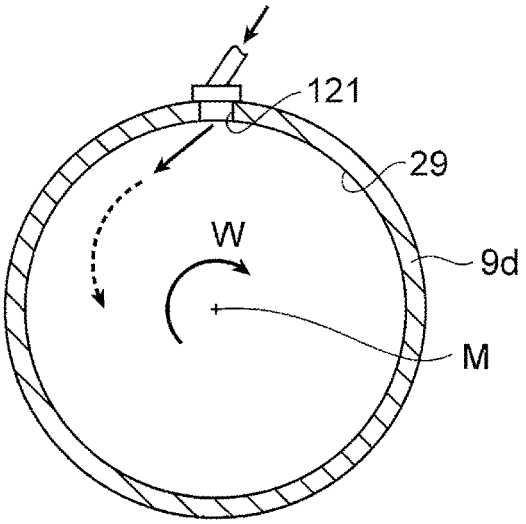
FIG. 16 is a cross-sectional view taken along line A-A in FIG. 15.

With reference to FIGS. 15 and 16, a seventh embodiment will now be described.

In the seventh embodiment, as a modification of the first embodiment, the reverse swirling flow generation unit 41 is additionally provided with a unit which generates reverse swirling flow in the air intake path 11, in addition to the guide vanes 43 so that a swirling air flow with a higher pressure is generated in the air intake path 11.

As shown in FIG. 15, a high pressure air outlet portion 121 is disposed at a portion of the air intake path 11 on the upstream side of the reverse swirling flow generation unit 41. FIG. 16 is a cross-sectional view taken along line A-A in FIG. 15. As shown in FIG. 16, the high pressure air outlet portion 121 ejects high pressure air so that swirling flow in a direction opposite to the rotation direction of the impeller 7 is generated.

In this configuration, the intake air flow flowing into the guide vanes 43 is set to be the reverse swirling flow in advance, whereby a strong reverse swirling flow can be generated by the guide vanes 43 and thus the effect of increasing the operating range is guaranteed.

As shown in a dotted line in FIG. 15, a high pressure air outlet portion 122 may be disposed at a portion of the air intake path 11 on the downstream side of the reverse swirling flow generation unit 41.

Embodiment 8

With reference to FIG. 17, an eighth embodiment will now be described.

In the eighth embodiment, as a modification of the first embodiment as in the case of the seventh embodiment, the reverse swirling flow generation unit 41 is additionally provided with a unit for generating a reverse swirling flow in the air intake path 11, in addition to the guide vanes 43. More specifically, an intake pipe 130, connected to the air intake path 11, has a shape of generating the reverse swirling flow.

As shown in FIG. 17, an intake pipe 131, connected to the air intake port 13, is formed of a bent tube 132 bent twice so that the intake air swirls in the direction of the reverse swirling flow.

Figure 17A:
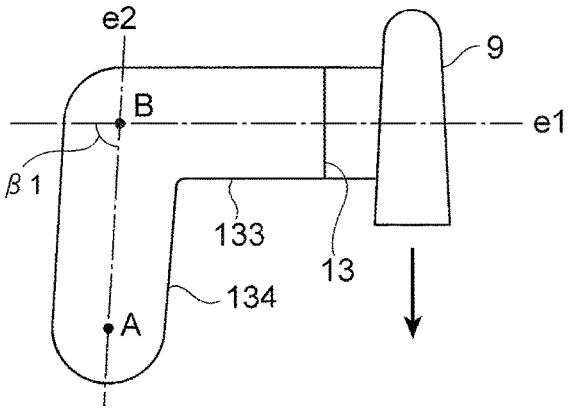
FIG. 17A is an explanatory diagram showing an eighth embodiment of the present invention and is a side view along the rotation axis direction of the centrifugal compressor.
Figure 17B:
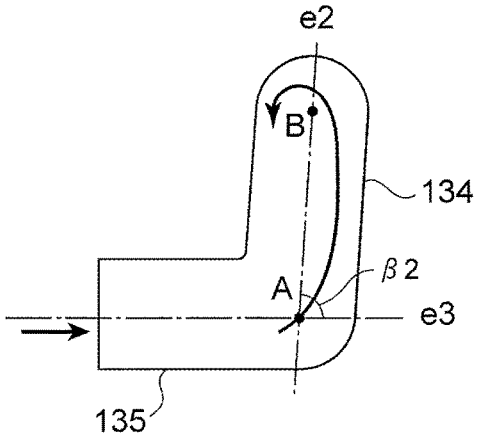
FIG. 17B is a front view of the centrifugal compressor as viewed in the rotation axis direction.
Figure 17C:
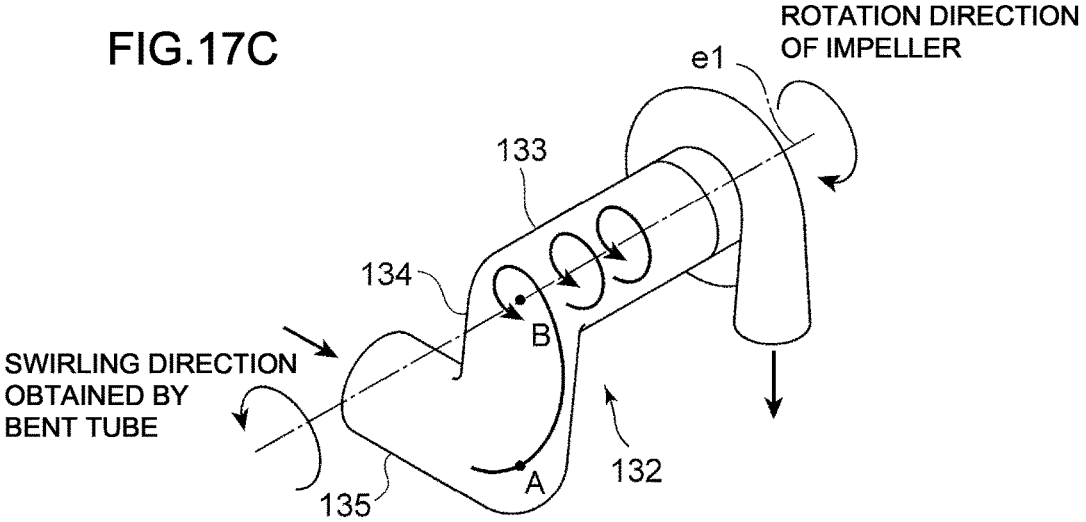
FIG. 17C is an explanatory perspective view of the centrifugal compressor shown in FIG. 17A.
Figure 18:
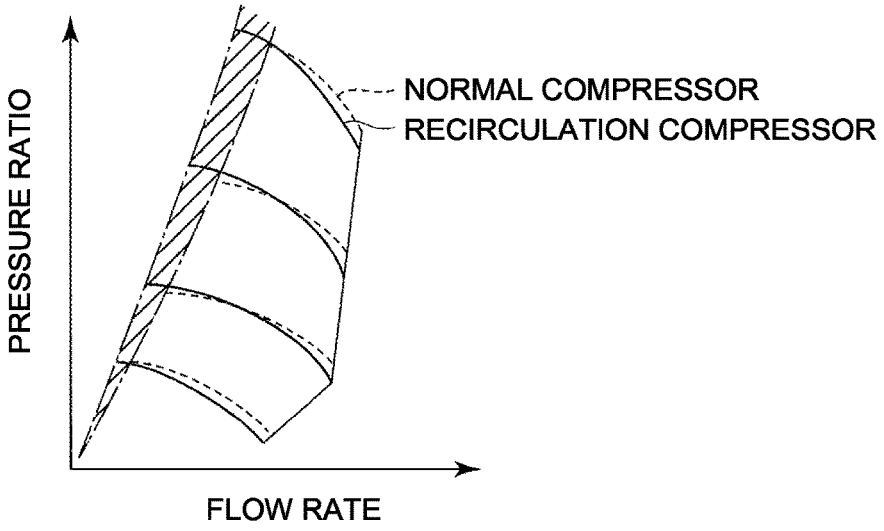
FIG. 18 is a performance characteristics comparison graph showing a relationship between the pressure ratio and the flow rate.
Figure 19:
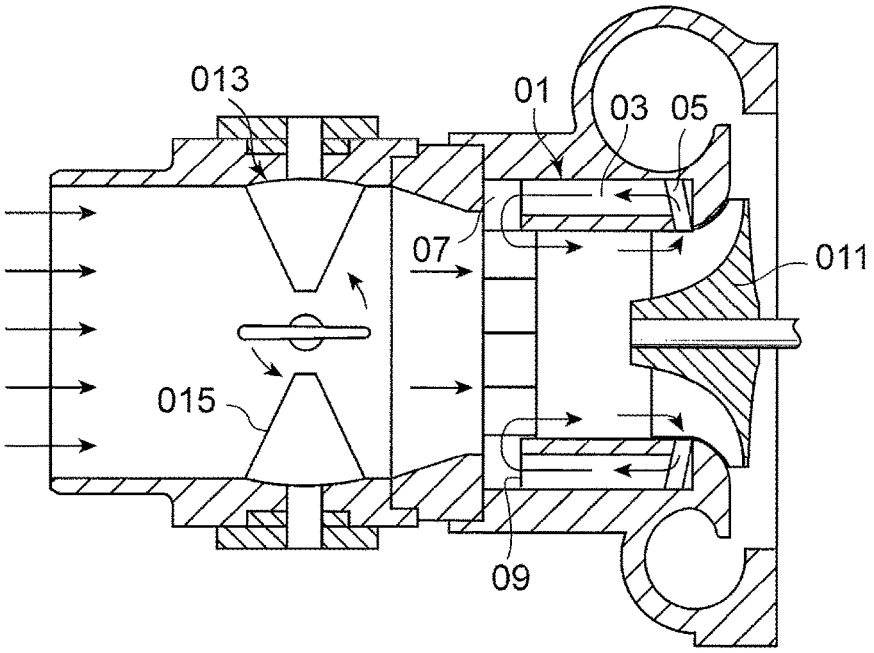
FIG. 19 is an explanatory diagram showing a conventional technique.

FIG. 17A is a side view along the rotation axis direction of the compressor 3. FIG. 17B is a front view of the compressor 3 in FIG. 17A as viewed in the rotation axis direction. FIG. 17C is a perspective view of the compressor 3 in FIG. 17A.

As shown in an overall perspective view in FIG. 17C, a first intake pipe 133, a second intake pipe 134, and a third intake pipe 135 are coupled to each other in such a manner that a center axis e2 of the second intake pipe 134 is inclined by β1 with respect to a center axis e1 of the first intake pipe 133 and the center axis e2 of the second intake pipe 134 is inclined by β2 with respect to a center axis e3 of the third intake pipe 135.

The first intake pipe 133, the second intake pipe 134, and the third intake pipe 135, connected to an upstream side of the air intake port 13, form the bent tube bent twice so that the swirling flow in a direction opposite to the rotation direction of the impeller 7 is generated. Thus, the intake air flow flowing into the guide vanes 43 is set to be the reverse swirling flow in advance so that the guide vanes 43 generate a strong reverse swirling flow. All things considered, the effect of increasing the operating range is guaranteed.

It is a matter of course that the seventh embodiment and the eighth embodiment, applied to the first embodiment in the above description, may be additionally combined with other embodiments.

INDUSTRIAL APPLICABILITY

According to the present invention, the operating range of the compressor can be increased on the low-flow-rate side and on the high-flow-rate side so that a stable operation can be achieved in a wide range, with a simple structure of combining the recirculation flow path with the reverse swirling flow generation unit and providing the fixed blades for generating reverse swirling flow, without providing a complicated movable guide vane mechanism. Thus, the present invention is effective as a technique applied to an exhaust turbocharger of an internal combustion engine.

REFERENCE SIGNS LIST

1 exhaust turbocharger
3 compressor (centrifugal compressor)
5 rotational shaft
7 impeller
9 compressor casing (casing)
9*a* upstream housing
9*b* downstream housing
11 air intake path
13 air intake port
15 diffuser
19 hub
21 blade
21*a* leading edge of blade
21*b* trailing edge of blade
21*c* shroud side of blade
25, 62, 82, 102 recirculation flow path
27, 65, 92, 110 downstream opening
31, 67 upstream opening
32 cylindrical member
41 reverse swirling flow generation unit
25 recirculation flow path
43, 51, 61, 81, 101 guide vanes (reverse swirling fixed blades)
29 inner peripheral wall
53 inner cylindrical member
55 center intake flow path
63, 63*a*, 63*b* strut
69, 83 cylindrical member
87 stopper portion
103 inner side cylindrical member
104 outer side cylindrical member
120*a*, 120*b* guide vane (protrusion)
121, 122 high pressure air outlet portion
133 first intake pipe
134 second intake pipe
135 third intake pipe
θ tilt angle guide vane

The invention claimed is:

1. A centrifugal compressor comprising:

a housing including: an air intake port open in a direction of a rotational shaft of the centrifugal compressor; and an air intake path connected to the air intake port;

an impeller which is disposed in the housing and compresses intake gas flowed in through the air intake port, the impeller being rotatable about the rotational shaft;

a reverse swirling flow generation unit which is disposed between the air intake port and the impeller in the housing, and generates a swirling flow of the intake gas, flowed in through the air intake port, in a direction opposite to a rotation direction of the impeller; and a recirculation flow path which communicates between an outer circumferential portion of the impeller with the air intake path on an upstream side of the impeller, wherein the reverse swirling flow generation unit includes a reverse swirling fixed blade which generates a swirling flow of the intake gas, which flows into the impeller, at a predetermined angle with respect to the direction opposite to the rotation direction of the impeller and a cylindrical member forming the recirculation flow path, the reverse swirling fixed blade is disposed at a portion of the air intake path between a flow inlet and a flow outlet of the recirculation flow path, the reverse swirling fixed blade being attached on an inner peripheral wall of the cylindrical member, the reverse swirling fixed blade radially extending in radial direction, and the reverse swirling fixed blade and the cylindrical member are formed as an integral structure.

2. The centrifugal compressor according to claim 1, wherein a tilt angle of a downstream end of the reverse swirling fixed blade is set to be a predetermined angle within a range of 5° to 45° with respect to the direction opposite to the rotation direction of the impeller.

3. The centrifugal compressor according to claim 1, wherein the reverse swirling fixed blade includes: a plurality of guide vanes which are attached to an inner circumferential wall of the air intake path, are disposed along a circumferential direction, and radially extend in a radial direction of the air intake path; and an inner cylindrical member which is provided to connect between inner circumference end portions of the plurality of guide vanes, and a center intake flow path is formed in the inner cylindrical member.

4. The centrifugal compressor according to claim 1, wherein the integral structure is formed by molding using a resin material.

5. The centrifugal compressor according to claim 1, wherein a strut or a protrusion is disposed in the recirculation flow path, the strut or the protrusion changing a flow direction of a circulation flow to the direction opposite to the rotation direction of the impeller.

6. The centrifugal compressor according to claim 1, wherein a strut extending along the direction of the rotational shaft is disposed in the recirculation flow path, and 5 to 20 or preferably 10 to 15 of the protrusions are disposed along the circumferential direction.

7. The centrifugal compressor according to claim 5, wherein the reverse swirling fixed blade, the recirculation flow path, and the strut or the protrusion disposed in the recirculation flow path are formed as an integral structure.

8. The centrifugal compressor according to claim 7, wherein the integral structure is formed by molding using a resin material.

9. The centrifugal compressor according to claim 1, wherein a high pressure air outlet portion is provided at a portion of the air intake path on the upstream side of the reverse swirling flow generation unit, the high pressure air outlet portion supplying high pressure air in a swirling direction of the reverse swirling flow.

10. The centrifugal compressor according to claim 1, wherein a high pressure air outlet portion is provided at a portion of the air intake path on the downstream side of the reverse swirling flow generation unit, the high pressure air outlet portion supplying high pressure air in a swirling direction of the reverse swirling flow.

11. The centrifugal compressor according to claim 1, wherein an intake pipe connected to an upstream side of the air intake port is formed of a bent tube so that intake air swirls in a direction of the reverse swirling flow.

12. A centrifugal compressor comprising:

a housing including: an air intake port open in a direction of a rotational shaft of the centrifugal compressor;

and an air intake path connected to the air intake port;

an impeller being rotatable about the rotational shaft;

a reverse swirling flow generation unit which is disposed between the air intake port and the impeller in the housing, and generates a swirling flow of the intake gas, flowed in through the air intake port, in a direction opposite to a rotation direction of the impeller; and a recirculation flow path which communicates between an outer circumferential portion of the impeller with the air intake path on an upstream side of the impeller, wherein the reverse swirling flow generation unit includes a reverse swirling fixed blade which generates a swirling flow of the intake gas, which flows into the impeller, at a predetermined angle with respect to the direction opposite to the rotation direction of the impeller, an inner cylindrical member forming the recirculation flow path, and an outer cylindrical member, the reverse swirling fixed blade is disposed at a portion of the air intake path on the upstream side of a flow outlet of the recirculation flow path, the reverse swirling fixed blade being arranged on an inner circumferential wall of the outer cylindrical member, the reverse swirling blade radially extending in radial direction, and the reverse swirling fixed blade, the inner cylindrical member, and the outer cylindrical member are formed as an integral structure.

13. The centrifugal compressor according to claim 12, wherein a tilt angle of a downstream end of the reverse swirling fixed blade is set to be a predetermined angle within a range of 5° to 45° with respect to the direction opposite to the rotation direction of the impeller.

14. The centrifugal compressor according to claim 12, wherein the reverse swirling fixed blade includes: a plurality of guide vanes which are attached to an inner circumferential wall of the air intake path, are disposed along a circumferential direction, and radially extend in a radial direction of the air intake path; and an inner cylindrical member which is provided to connect between inner circumference end portions of the plurality of guide vanes, and a center intake flow path is formed in the inner cylindrical member.

15. The centrifugal compressor according to claim 12, wherein the integral structure is formed by molding using a resin material.

16. The centrifugal compressor according to claim 12, wherein a strut or a protrusion is disposed in the recirculation flow path, the strut or the protrusion changing a flow direction of a circulation flow to the direction opposite to the rotation direction of the impeller.

17. The centrifugal compressor according to claim 12, wherein a strut extending along the direction of the rotational shaft is disposed in the recirculation flow path, and 5 to 20 or preferably 10 to 15 of the protrusions are disposed along the circumferential direction.

18. The centrifugal compressor according to claim 16, wherein the reverse swirling fixed blade, the recirculation flow path, and the strut or the protrusion disposed in the recirculation flow path are formed as an integral structure.

19. The centrifugal compressor according to claim 18, wherein the integral structure is formed by molding using a resin material.

20. The centrifugal compressor according to claim 12, wherein an intake pipe connected to an upstream side of the air intake port is formed of a bent tube so that intake air swirls in a direction of the reverse swirling flow.

* * * * *